United States Patent [19]

Nicolas

[11] Patent Number: 4,938,799

[45] Date of Patent: Jul. 3, 1990

[54] HEAVY TUNGSTEN-NICKEL-IRON ALLOYS WITH VERY HIGH MECHANICAL CHARACTERISTICS AND PROCESS FOR THE PRODUCTION OF SAID ALLOYS

[75] Inventor: Guy Nicolas, Bonneville, France

[73] Assignee: Cime Bocuze, Courbevoie, France

[21] Appl. No.: 253,506

[22] Filed: Oct. 5, 1988

[30] Foreign Application Priority Data

Oct. 23, 1987 [FR] France ..... 87 15315

[51] Int. Cl.[5] ..... C32C 28/00

[52] U.S. Cl. ..... 75/248; 419/23; 419/28; 419/29; 419/38; 419/54; 419/55; 419/60

[58] Field of Search ..... 75/248; 419/23, 60, 419/28, 29, 38, 54, 55

[56] References Cited

U.S. PATENT DOCUMENTS

| | | | |
|---|---|---|---|
| 3,888,636 | 6/1975 | Sczerzenie et al. | 29/182 |
| 3,988,118 | 10/1976 | Grierson et al. | 29/182 |
| 4,090,875 | 5/1978 | Ludwig | 75/248 |
| 4,762,559 | 9/1988 | Penrice et al. | 75/248 |

*Primary Examiner*—Stephen J. Lechert, Jr.
*Assistant Examiner*—Nina Bhat
*Attorney, Agent, or Firm*—Dennison, Meserole, Pollack & Scheiner

[57] ABSTRACT

The invention relates to heavy tungsten-nickel-iron alloys with high mechanical characteristics and a specific gravity between 15.6 and 18. The alloys include a tungsten $\alpha$-phase in the shape of butterfly wings with dislocation cells of dimensions between 0.1 and 1 $\mu$m, and a nickel-iron bonding $\gamma$-phase having a mean free path of less than 15 $\mu$m and an Ni/Fe ratio greater than or equal to 2.

3 Claims, 3 Drawing Sheets

200x

200x

200x

1000x

1000x

2600x 35,000x 30,000x 60,000x

HEAVY TUNGSTEN-NICKEL-IRON ALLOYS WITH VERY HIGH MECHANICAL CHARACTERISTICS AND PROCESS FOR THE PRODUCTION OF SAID ALLOYS

The present invention relates to heavy tungsten-nickel-iron alloys with very high mechanical characteristics and a process for the production of said alloys.

The man skilled in the art knows that materials which are intended for the production of balancing weights, screens for the absorption of vibration and X, $\alpha$, $\beta$, $\gamma$ rays, and projectiles having a high perforation capacity, must be of a relatively substantial specific mass.

It is for that reason that, for the production thereof, recourse is had to alloys which are referred to as "heavy" alloys, primarily containing tungsten which is homogenously distributed in a metal matrix generally formed by bonding elements such as nickel and iron. In most cases those alloys have an amount of tungsten by weight which is between 90 and 98% and a specific gravity of from 15.6 to 18. They are essentially produced by powder metallurgy, that is to say the components therof are used in the powder state, compressed to impart the appropriate shape thereto, sintered and stabilized to give them mechanical solidty and possibly subjected to an operation for working and heat treatment thereof in order for them to acquire mechanical characteristics: strength, elongation and hardness, which are suited to the use to which they are to be put.

The teaching of such alloys is set forth for example in U.S. Pat. No. 3 979 234 which describes a process for the production of W-Ni-Fe alloy comprising:

preparing a homogenous mixture of powders containing by weight 85–96% W, the balance being nickel and iron in a Ni/Fe ratio by weight of from 5.5 to 8.2, compressing the mixture in the form of compacted items, sintering the compacted items in a reducing atmosphere at a temperature of at least 1200° C. and below the temperature at which at liquid phase appears for a sufficient period to produce a product with a density of at least 95% of the theoretical density, heating the product at a temperature which is between 0.1° and 20° C. above the temperature at which a liquid phase appears for a period of time suficient to cause a liquid phase to appear but insufficient to produce deformation of the product, heating the product under vacuum at between 700° and 1420° C. for a sufficient time to degas it, and machining it to the desired dimensions, which operation can be preceded by at least one working pass to increase the strength thereof.

Under those conditions, what is obtained is for example a product which, after a working operation which results in a reduction in surface area of 31%, has an ultimate tensile strength RM of 1220 MPa, a yield strength R 0.2 of 1180 MPa, a degree of elongation E of 7.8% and Rockwell C hardness: HRc, of 41. Those characteristics are sufficient for certain uses but for uses which involve higher levels of loading, they are found to be markedly inadequate as the need is now for levels ultimate tensile strength which are higher than 1600 MPa and which can go up to 2000 MPa.

The present invention concerns heavy alloys of a specific gravity of between 15.6 and 18 and containing by weight between 80 and 99% of tungsten as well as nickel and iron in an Ni/Fe ratio by weight which is higher than or equal to 1.5 and optionally other elements such as molybdenum, titanium, aluminium, manganese, cobalt and rhenium, which have very high mechanical characteristics and in particular an ultimate tensile strength which can be up to 2000 MPa for a degree of elongation of at least 1%.

According to the invention those heavy alloys are characterized in that they have a structure in which the tungsten $\alpha$ phase is in the shape of butterfly wings with dislocation cells of dimensions of between 0.01 and 1 $\mu$m.

It is known to the man skilled in the art that tungsten-nickel-iron alloys have a structure formed by nodules of pure tungsten which are more or less spheroidised in the sintering operation, constituting the $\alpha$ phase, said nodules being surrounded by a $\gamma$ phase composed of the three elements of the alloy which performs the function of bonding between said nodules.

The applicants found that, to develop very high mechanical characteristics, the tungsten alloys had to be of a particular structure.

Thus, from the morphological point of view, if a surface which is transverse to the direction of working is examined on a testpiece obtained from such alloys, it is found that:

the $\alpha$ phase is no longer of a spheroidised shape but is rather in the shape of ellipsoids which are linked together in pairs in the vicinity of one of the ends of their long axis so as to form an acute angle between said axes, that arrangement being more generally referred to as "butterfly wings", and the bonding $\gamma$ phase has a mean free path which decreases in proportion to increases in the ultimate tensile strength in paricular. Thus, below 15 $\mu$m, values of higher than 1600 MPa are attained.

The expression mean free path is used herein to denote the average of the distances which in a given direction separate two successive zones of $\gamma$ phase.

From the point of view of microstructure, by taking thin slices, the presence is found in the $\alpha$ phase of dislocation cells of dimensions of between 0.01 and 1 $\mu$m which decrease in proportion to a rise in the mechanical characteristics of the material. In accordance with that rise, disorientation of the cells relative to each other is also observed. It is thought that it is those cells which give such alloys the plasticity necessary for deformation thereof. In addition, examination on a testpiece of the surface parallel to the direction of working reveals a fibrous texture which becomes more pronounced in proportion to increasing mechanical characteristics. Those fibres are characterised by a particular orientation which, in accordance with the Miller indices, corresponds to the direction <110>for the poles <110->in the central part of the testpiece.

Moreover, the increase in mechanical characteristics beyond a level of 1500 MPa through polygonisation of the $\alpha$ phase. As a complementary aspect, a precipitation network in respect of the $\gamma$ phase is developed in the area of contiguity of the nodules of the $\alpha$ phase.

The invention also concerns a process for the production of alloys having such a structure, in which it is possible to regulate as desired the value of the required mechanical characteristics and in particular to achieve a breaking strength of close to 2000 MPa.

In order to achieve that, the applicants developed treatment of the alloys which makes it possible to promote plastic deformation of the $\alpha$ phase, having regard to the fact that the latter is normally fragile but has a high elastic limit.

The process comprises the steps which are already known and which consist of:

using powders of each element of the alloy, each thereof being of a FISHER diameter of between 1 and 15 μm, mixing said powders in proportions corresponding to the composition of the desired alloy, compressing said powders in the form of compacted items, sintering the compacted items at between 1490 and 1650° C. for from 2 to 5 hours, treating the sintered compacted items under vacuum at between 1000° and 1300° C. and subjecting the resulting compacted items to at least one working pass.

However, what characterises that process is that after treatment under vacuum the compacted items are subjected to at least three cycles of operations, each cycle comprising a working step followed by a heat treatment.

Thus, the invention consists of a succession of cycles which are of an increasing number in proportion to the wish to attain structures corresponding to the highest values of the mechanical characteristics involved. Thus, three cycles make it possible to attain a level of ultimate tensile, strength which is between 1400 and 1450 MPa while at the end of four cycles, values of close to 1850 MPa are achieved. Each of those cycles comprises, in the following order, a working step which is effected for example by hammering so as to develop a certain degree of reduction in surface area of the sintered compacted item of between 10 and 50% followed by an annealing treatment by putting them in a furnace heated to a temperature of less than 1300° C. in an inert atmosphere for 4 to 20 hours.

Preferably in the course of the first two cycles the levels of working are lower and the temperatures are higher than in the course of the subsequent cycles. In the fourth cycle, the appropriate level of working is achieved by effecting at least two successive passes in the hammering apparatus for example before effecting the heat treatment.

The invention can be illustrated by means of the accompanying drawings in which, in respect of an alloy containing by weight 93% of tungsten, 5% of nickel and 2% of iron:

FIGS. 1, 2 and 3 show the structures under a magnification of 200 of transverse sections of testpieces which respectively exhibit an ultimate tensile strength of 1100, 1540 and 1850 MPa.

FIGS. 4, 5 and 6 show microstructures of facies in respect of rupture under a tensile strength obtained from the same testpieces, under respective degrees of magnification of 1000-1000-2600, and FIGS. 7, 8 and 9 show microstructures obtained by viewing thin slices under an electron microscope under levels of magnification of 35,000, 30,000 and 60,000 respectively, revealing the specific state of the α phase which makes it possible to achieve the desired characteristics.

Referring to FIG. 1, shown therein in white is the nodular structure of the tungsten α phase and the bonding γ phase whose means free path is close to 20 μm.

FIG. 2 shows the formation of butterfly wings while the mean free path is reduced to about 10 to 14 μm.

In FIG. 3, the trend noted in FIG. 2 is accentuated and the mean free path is in the range of from 3 to 7 μm.

In FIG. 4 the rupture in the alloy is essentially internodular and cupular in regard to the γ phase.

In FIGS. 5 and 6 corresponding to testpieces of higher characteristics than those shown in FIG. 4, it is noted that the total rupture mode becomes transnodular with infrequent internodular rupture initiations. At the level of the microstructure of the γ phase states of substructures are developed.

Figure 1:
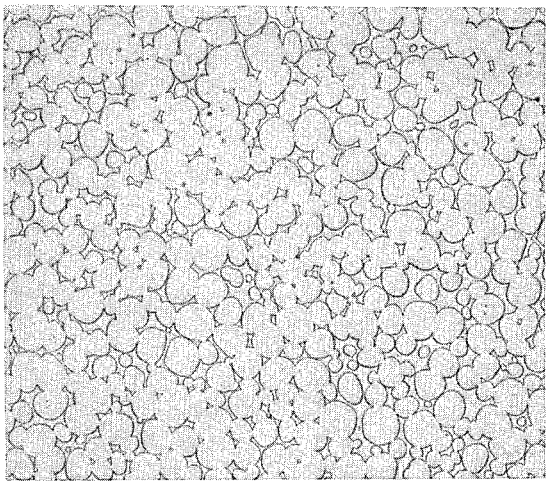
Figure 2:
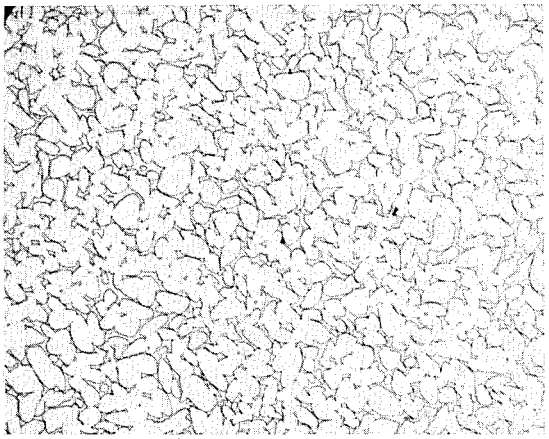
Figure 3:
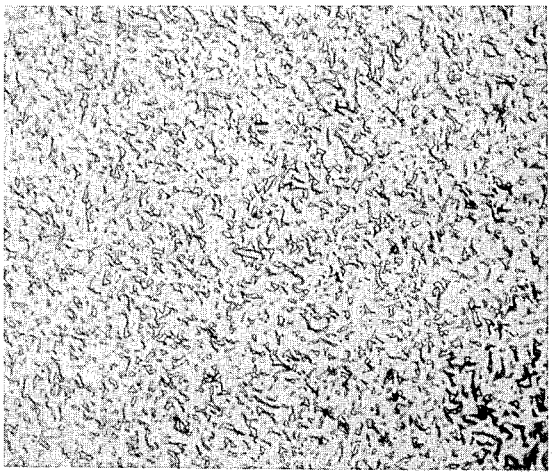
Figure 4:
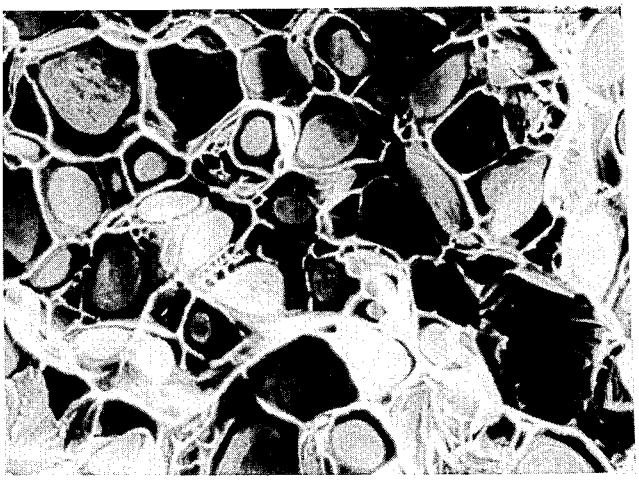
Figure 5:
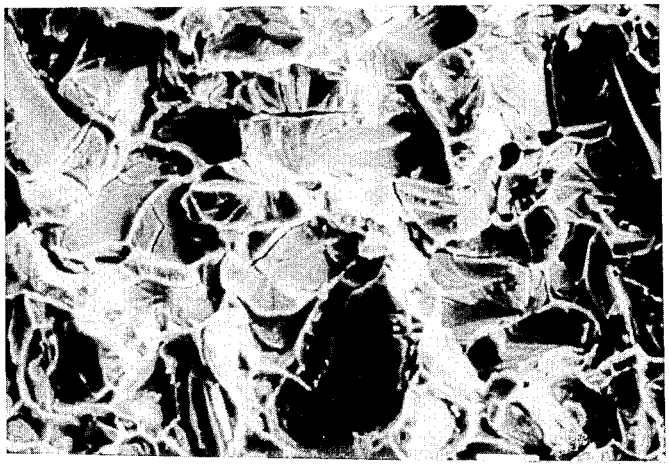
Figure 6:
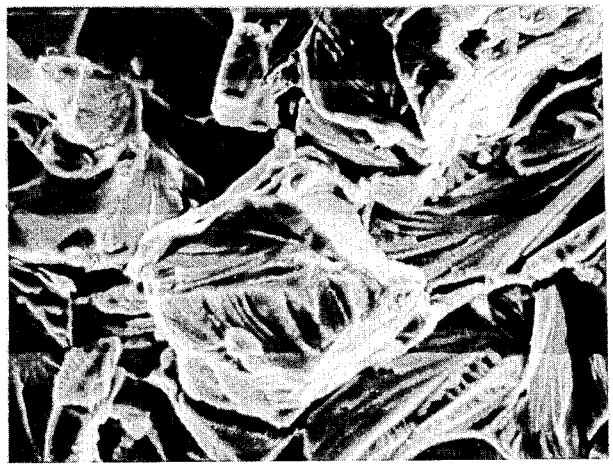
Figure 7:
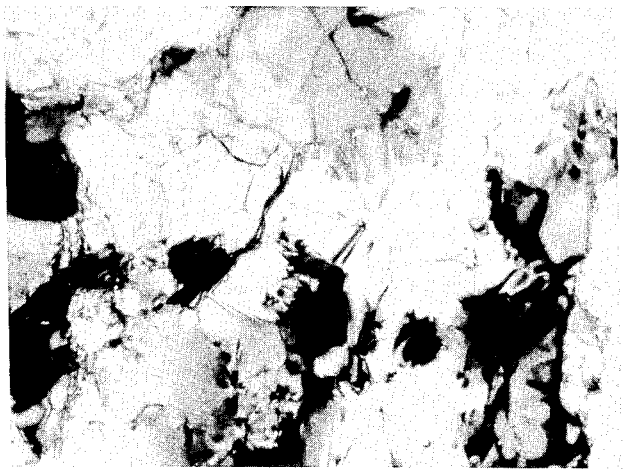
FIG. 7 shows a restoration structure with rearranged cells of a size to from 0.4 to 0.8 μm.
Figure 8:
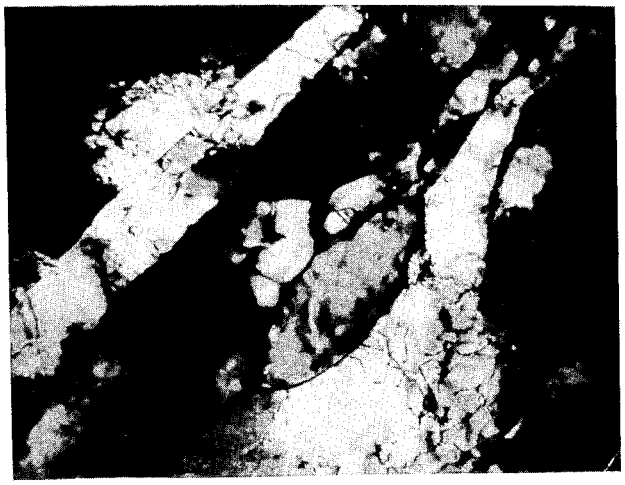
FIG. 8 shows the polygonised step, which is necessary in order to go to the highest characteristics.
Figure 9:
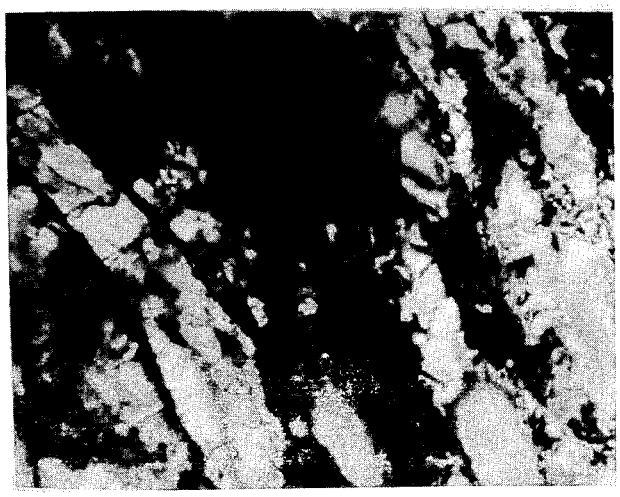
FIG. 9 shows a typical structure of the highest characteristics with development of dislocation microcells of from 0.05 to 0.01 μm.

The invention can be illustrated by reference to the following example of use thereof:

Elementary powders of a FISHER diameter of between 1.4 and 10 μm were mixed so as to obtain a product of the following composition by weight: W 93% - Ni 5% - Fe 2%.

After isostatic compression under a pressure of 230 MPa, the compacted items, measuring 90 mm in diameter and 500 mm in length, were sintered in a tunnel furnace at a temperature of 1490° C. for 5 hours and the kept under partial vacuum for a period of 25 hours in a furnace heat at between 900° and 1300° C.

The products obtained in that way were then treated in accordance with the invention. The particular conditions under which the cycles were effected as well as the mechanical characteristics μm (ultimate tensile strength), R 0.2 (yield strength to 0.2% of elongation) E (elongation), VH30 (Vickers hardness) and RHc (Rockwell hardness) obtained in the different treatment cycles were set forth in the following table:

| | | Heat treatment | | UTS | YS | | | |
|---|---|---|---|---|---|---|---|---|
| Cycle No. | Degree of working % | Temp. in °C. | Period in hours | Rm in MPa | Rp 0.2 MPa | E % | VH30 Hardness | RHc Hardness |
| 1 | 10–20 | | | 1050 | 1010 | 8 | 400 | 30 |
| | | 700/ 1200 | 4–8 | 1100 | 1050 | 8 | 420 | 38 |
| 2 | 10–15 | | | 1330 | 1310 | 5 | 470 | 45 |
| | | 500/ 1100 | 4–8 | 1150 | 1000 | 20 | 380 | 38 |
| 3 | 20–50 | | | 1400 | 1320 | 9 | 470 | 40 |
| | | 500/ 1000 | 4–8 | 1450 | 1400 | 8 | 500 | 44 |
| 4 | 40–60 | | | 1820 | 1800 | 5 | 530 | 48 |
| | 30–50 | | | 1840 | 1830 | 4 | 540 | 49 |
| | | 500/ | 6–20 | 1850 | 1810 | 5 | 530 | 48 |

-continued

| Cycle No. | Degree of working % | Heat treatment Temp. in °C. | Period in hours | UTS Rm in MPa | YS Rp 0.2 MPa | E % | VH30 Hardness | RHc Hardness |
|---|---|---|---|---|---|---|---|---|
| | | 900 | | | | | | |

It is found therefore that the breaking strength increases substantially when the number of cycles increases and that the degree of elongation remains sufficient to permit transformation of the alloy.

I claim:

1. Heavy alloy with very high mechanical characteristics and a specific gravity between 15.6 and 18, comprising:

80 to 99% by weight of tungsten in the form of nodules constituting an α-phase in the shape of butterfly wings with dislocation cells of dimensions between 0.1 and 1 μm, and nickel and iron in an Ni/Fe ratio greater than or equal to 2 constituting a bonding γ-phase, with a mean free path of less than 15 μm, said alloy having an ultimate tensile strength higher than 1500 MPa, and a polygonised α-phase.

2. Alloy according to claim 1 wherein the α phase has a fibrous texture of a direction <110>.

3. Alloy according to claim 1 wherein the γ phase forms a precipitation network in the area of contiguity of the nodules of the α phase.

* * * * *